United States Patent [19]

Bowen

[11] 3,950,898

[45] Apr. 20, 1976

[54] SAFETY RAZOR BLADE WATER HONER

[76] Inventor: Hilary T. Bowen, 6116 Chanceford Road, Baltimore, Md. 21228

[22] Filed: Feb. 13, 1975

[21] Appl. No.: 549,471

[52] U.S. Cl. ..... 51/216 R; 51/285; 51/320

[51] Int. Cl.[2] ..... B24B 3/48; B24C 3/32; B24C 7/00

[58] Field of Search ..... 51/7, 8 R, 11, 216 R, 51/218 R, 218 P, 281 R, 285, 317, 318, 320, 321; 312/42, 43, 49, 45, 72; 206/228; 134/199; D87/1 R; D6/88, 95

[56] References Cited

UNITED STATES PATENTS

| | | | |
|---|---|---|---|
| 1,702,203 | 2/1929 | Day | 51/8 R |
| 2,138,520 | 11/1938 | Elliot | 51/285 X |
| 3,601,837 | 8/1971 | Conrad | 51/8 R X |

FOREIGN PATENTS OR APPLICATIONS

| | | | |
|---|---|---|---|
| 879,793 | 11/1942 | France | 312/49 |

*Primary Examiner*—Donald G. Kelly
*Attorney, Agent, or Firm*—J. Wesley Everett

[57] ABSTRACT

The razor blade sharpener comprises a flexible tube of such length as to accommodate the handle of a razor blade supporting element having one end of the tube adapted to frictionally engage a water outlet faucet, the opposite end of the tube being provided with a flexible band positioned diametrically across the end of the tube for supporting a razor blade supporting element adjacent the opposite end of the tube, allowing water from the faucet to flow through the tube and over the edge of the razor blade which is being held in position by the razor blade support.

1 Claim, 3 Drawing Figures

SAFETY RAZOR BLADE WATER HONER

The present invention relates to a razor blade sharpener and in particular to a device in which water is used to cause a honing effect on the cutting edge of the blade.

One object of the invention is to provide a simple and inexpensive razor blade sharpener without the removal of the blade from the blade holder.

Another object of the invention is to provide a razor blade sharpener with no moving parts.

A further object of the invention is to provide a razor blade sharpener which will take advantage of the eroding action of water moving over the cutting edge of the razor blade.

While several objects of the invention have been set forth, other objects, uses and advantages will become more apparent as the nature of the invention is more fully described in the following description with reference to the accompanying drawings in which.

In referring to the drawings, like characters are used to point out like and similar parts throughout the several views.

Figure 3:
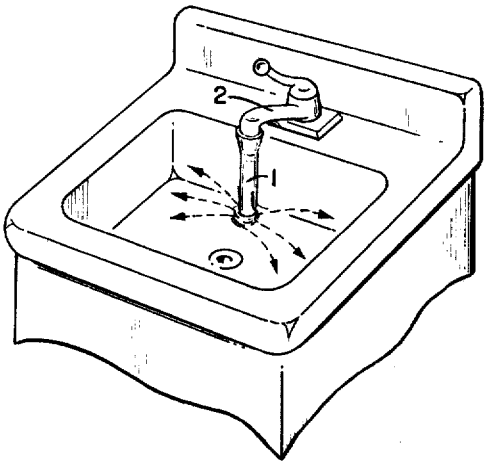
FIG. 3 is a perspective view of a wash basin and sharpener on a reduced scale, showing the manner in which the sharpener is used.
Figure 1:
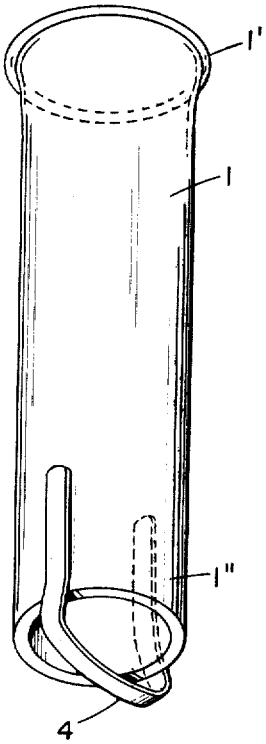
FIG. 1 is a perspective view of the sharpener.

The razor blade sharpener comprises the flexible tube 1 made preferably of rubber or other suitable material in which at least the first end thereof is of a suitable diameter to be extended over the outer end of a water faucet 2, being held to the faucet by the elasticity of the tube during the sharpening operation.

The razor blade is normally carried in a supporting element 3 having a handle portion 3' and a head portion including a pair of blade holding elements 3'' and 3'''. The outer blade holding element 3''' is normally provided with a threaded stem (not shown) adapted to be threadably receivable into the adjacent end of the handle 3'. The blade holding element 3'' having an aperature which slideably receives the stem so that when the stem is screwed into the handle, the blade 7 and the holding element 3'' are compressed between the end of the handle and the holding member 3''.

The second end 1'' of the tube is provided with a stretchable band 4 forming a razor head support surface. Ends 4' and 4'' of the band 4 are fixed to the side of the tube adjacent second end 1'' by an adhesive or other suitable means. The band 4 is secured to the tube upwardly from the open end thereof at 5 and 5' and forms a razor head support surface which extends beyond the periphery of the tube end as illustrated in FIG. 2 in order to allow the water moving through the tube to flow freely about the edge of the razor blade 7 in the area of the band 4 and also to allow working room for inserting the razor supporting element into the tube.

After each shave the razor blade and supporting element are disassembled and the blade and element thoroughly cleaned. The blade is turned over in the support after each cleaning in order that the honing effect will be carried out on each side edge of the blade in alternate honing.

Figure 2:
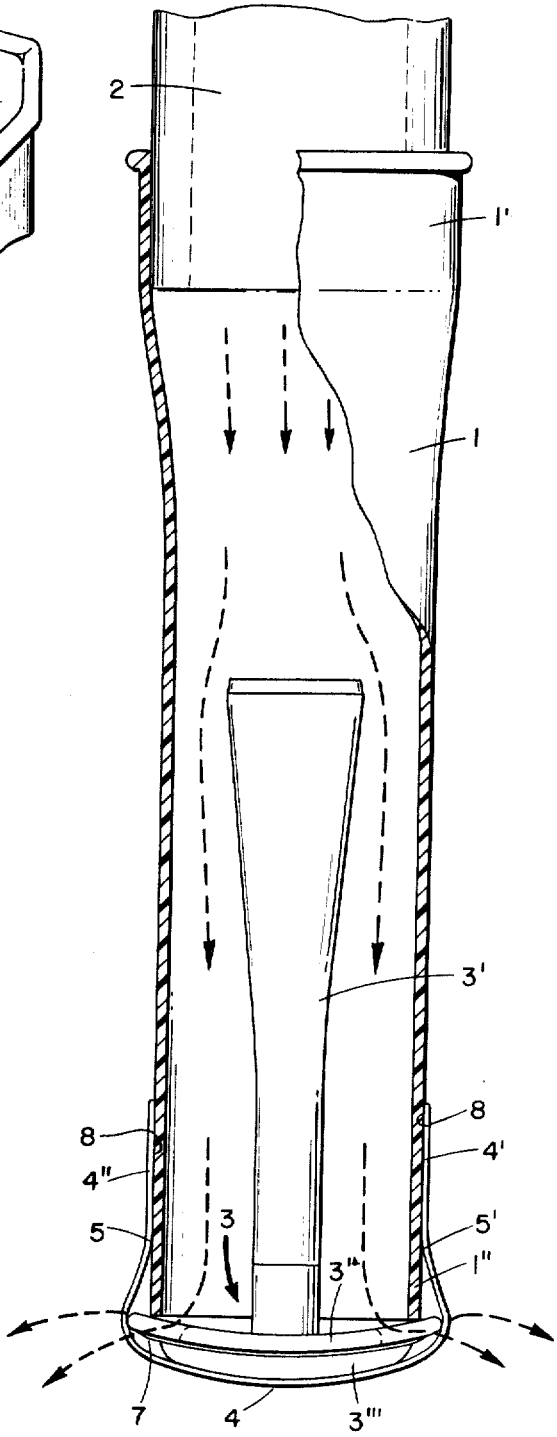
FIG. 2 is an enlarged view partly in elevation and partly in sections showing one type of conventional razor positioned within the sharpener.

In operation the blade supporting element 3 is assembled as shown in FIG. 2. The handle member 3' is preferably loosened slightly from the blade gripping elements 3'' and 3''' in order that the blade 7 be retained loosely between the two holding members so that the water flows evenly over the entire edge of the blade. The handle portion 3' of the blade supporting element 3 is inserted into the tube 1 which is shown best in FIG. 2 and the blade gripping elements 3'' and 3''' are inserted under the flexible band 4. The first end 1' of the tube 1 is extended over the outer surface of a water faucet 2, as shown in FIG. 3. The faucet is turned on and the water passes down through the tube as shown by the arrow in FIG. 2 and out over the cutting edge 7' and 7'' of the razor blade 7.

Although the liquid used is described as water, any other suitable liquid may be used and while a specific type razor is shown and described, the device may be modified to accommodate other similar type razors.

While the invention is shown and described in a specific form, it is not intended as a limitation as modifications of the sharpener may be made that may be within the scope of the appended claims.

I claim:

1. A device for supporting a razor during a water honing operation for sharpening razor blade edges, said device comprising:

a. a flexible tube element, open at both ends, for containing a razor handle, said element having an elastically extensible first end for mounting on a water faucet outlet;

b. a narrow band element affixed near and extending across a second end of said tube element to form a support surface for a blade-holding razor head affixed to said handle, said support surface extending outwardly beyond the periphery of the second end to support the head against the second end;

whereby a razor held by the device with the head extending across the lower end thereof and supported thereagainst by the narrow band element while the first tube end is elastically engaged with a water faucet, will have the razor blade honed by water flowing through the tube and out the second tube end across the blade edges.

* * * * *